US012042014B2

(12) United States Patent
Donnadieu et al.

(10) Patent No.: US 12,042,014 B2
(45) Date of Patent: Jul. 23, 2024

(54) ARTICLE OF FOOTWEAR

(71) Applicant: SALOMON S.A.S., Epagny Metz-Tessy (FR)

(72) Inventors: Thierry Donnadieu, Sillingy (FR); Guillaume Salmon, Annecy (FR); Joseph Normand, Aix les Bains (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 88 days.

(21) Appl. No.: 18/082,236

(22) Filed: Dec. 15, 2022

(65) Prior Publication Data

US 2023/0189931 A1 Jun. 22, 2023

(30) Foreign Application Priority Data

Dec. 17, 2021 (FR) ..... FR2113774

(51) Int. Cl.

| | |
|---|---|
| ***A43C 11/00*** | (2006.01) |
| ***A43B 23/02*** | (2006.01) |
| ***A43C 1/00*** | (2006.01) |
| ***A43C 5/00*** | (2006.01) |
| ***A43C 11/12*** | (2006.01) |

(52) U.S. Cl.

CPC ..... *A43C 1/003* (2013.01); *A43B 23/025* (2013.01); *A43C 1/00* (2013.01); *A43C 5/00* (2013.01); *A43C 11/12* (2013.01)

(58) Field of Classification Search

CPC ..... A43C 1/00; A43C 5/00; A43C 11/12
USPC ..... 36/50.1
See application file for complete search history.

(56) References Cited

U.S. PATENT DOCUMENTS

| | | | | |
|---|---|---|---|---|
| 2,287,985 | A * | 6/1942 | Gookin | A43C 5/00 24/715.1 |
| 7,685,739 | B2 * | 3/2010 | Aveni | A43B 3/24 36/8.3 |
| 2002/0166260 | A1 * | 11/2002 | Borsoi | A43B 5/0401 36/50.1 |
| 2003/0154627 | A1 * | 8/2003 | Hirayama | A43B 7/14 36/55 |

(Continued)

FOREIGN PATENT DOCUMENTS

WO 2020/214379 A1 10/2020

OTHER PUBLICATIONS

French Search Report issued in French patent application No. FR 2113774, dated Aug. 3, 2022.

*Primary Examiner* — Marie D Bays
(74) *Attorney, Agent, or Firm* — GREENBLUM & BERNSTEIN, P.L.C.

(57) ABSTRACT

Article of footwear comprised of an upper that includes a vamp, the vamp including a first wall, at least two keepers configured to receive a portion of a lace, each keeper being arranged on either side of a sagittal plane of the article of footwear. Each loop is defined by the following: the interstitial space between the first wall and a yoke locally covering an outer surface of the first wall, the interstitial space having an anterior opening and a posterior opening through which a portion of the lace extends, and an upper linkage between the first wall and the yoke, the upper linkage being achieved due to a first affixer located in a first connection zone close to the sagittal plane, whereby the yoke is superimposed on the first wall without folding.

10 Claims, 9 Drawing Sheets

(56) References Cited

U.S. PATENT DOCUMENTS

| | | | | |
|---|---|---|---|---|
| 2004/0181972 | A1* | 9/2004 | Csorba | A43B 23/0265 36/50.1 |
| 2009/0071041 | A1* | 3/2009 | Hooper | A43B 23/0245 36/25 R |
| 2009/0277043 | A1* | 11/2009 | Graser | A43B 7/1495 36/91 |
| 2010/0064547 | A1* | 3/2010 | Kaplan | A43B 23/07 36/50.1 |
| 2012/0011744 | A1 | 1/2012 | Bell et al. | |
| 2017/0181501 | A1 | 6/2017 | Gautier et al. | |
| 2019/0313742 | A1 | 10/2019 | Bell et al. | |
| 2022/0312897 | A1* | 10/2022 | Wehrmeyer | A43C 5/00 |

* cited by examiner

ARTICLE OF FOOTWEAR

CROSS-REFERENCE TO RELATED APPLICATION

This application is based upon French Patent Applications No. FR 21 13774, filed Dec. 17, 2021, the disclosure of which is hereby incorporated by reference thereto in its entirety, and the priority of which is claimed under 35 U.S.C. § 119.

BACKGROUND

1. Field of the Invention

The present invention relates to an article of footwear, such as a walking shoe or a sports shoe.

2. Background Information

A shoe of this type comprises an upper connected to a sole assembly in its lower portion. The upper is composed of a vamp and quarters. The vamp generally demarcates an upper opening located in the area of the user's instep. To ensure adequate foot support, the shoe incorporates a tightening system comprising at least one lace extending through a series of keepers along the edge of the upper opening.

A number of constructions can be envisioned to produce these keepers.

A conventional solution involves perforating the vamp with a plurality of holes located at the edge of the upper opening. Each of these openings is usually reinforced to form an eyelet through which the shoelace passes. This construction requires the lace to pass under the vamp, which can generate a hard spot during tightening and, thus, a discomfort for the user. In addition, these openings do not provide adequate insulation.

Another solution involves fixing a loop, a hook or a keeper, which may be metallic or plastic, to the vamp. This attached element is intended to guide the lace along a defined lacing path. This solution is more complex and expensive as it requires fixing additional parts. In addition, the use of attached keepers adds an extra thickness to the vamp in the area of the keepers which may catch on external elements.

An alternative solution involves turning a plurality of straps or portions of a yoke over themselves to form loops through which the lace extends. Each loop the forms a keeper of the tightening system. This construction is simple and cost-effective, but also adds extra thickness to the vamp in the area of the keepers due to the strap or yoke portion overlapping in the area in which it is folded/turned over. This extra thickness can also catch on external elements.

SUMMARY

The invention provides a construction of an article of footwear, the keepers of the tightening system of which are as close to the upper as possible, so as to be integrated into the vamp.

The invention provides a particularly flat keepers, which are compact and reduce the surfaces that catch on external elements.

The invention also provides a comfortable tightening system.

Further, the invention provides a cost-effective tightening system.

Still further, the invention provides a tightening system comprising keepers for which production can be automated.

The invention provides an article of footwear comprised of an upper comprising a vamp including

- a first wall,
- at least two keepers intended to receive a portion of a lace, each keeper being arranged on either side of a sagittal plane of the article of footwear.

The article of footwear is characterized in that each keeper, or each of a plurality of keepers, is defined by

- the interstitial space between the first wall and a yoke locally covering an outer surface of the first wall, the interstitial space having a front opening and a rear opening through which a portion of the lace extends, and
- an upper linkage between the first wall and the yoke, the upper linkage being achieved due to a first affixing means located in a first connection zone close to the sagittal plane, the yoke being superimposed on the first wall without folding.

This specific shoe construction makes it possible to design particularly flat and compact keepers that fit completely into the vamp of the upper and, thus perfectly assuming the shape of the vamp, reduce the asperities projecting from the vamp. As a result, the risk of catching on an external element, such as a branch or a root, is reduced, unlike a construction comprising keepers formed by loops or attached elements. Furthermore, this construction produces a soft and flexible shoe, which avoids "hard spots" during tightening and significantly improves the comfort of the foot when tightened. Furthermore, the proposed construction is particularly advantageous from an industrial point of view. Indeed, these keepers can be made with conventional industrial means. The vamp can thus be assembled flat, in particular in the area of the upper linkage between the first wall and the yoke. Due to this construction, the process for making these keepers could easily be automated.

According to advantageous but non-essential aspects of the invention, such an article of footwear can incorporate one or more of the following characteristics, taken in any technically acceptable combination:

- the yoke includes an inner layer made with a low-abrasive material. Advantageously; the yoke comprises at least two layers, including an outer layer and an inner layer, the inner layer being an attached component fixed to the inner surface of the outer layer;
- the first affixing means is a zigzag stitch. Advantageously, this stitch has a length greater than 5 mm and a width greater than 2 mm;
- the yoke is fixed to the first wall by a second affixing means located in a second connection zone distant from the first affixing means, moving away from the sagittal plane, so that the distance between the two affixing means is between 5 mm and 10 mm;
- the yoke is connected to a sole assembly of the article of footwear; and
- the same yoke is used and dimensioned to make a plurality of keepers.

Advantageously, the same yoke makes it possible to produce keepers on either side of a sagittal plane.

BRIEF DESCRIPTION OF DRAWINGS

Other characteristics and advantages of the invention will be better understood from the detailed description that follows, with reference to the annexed drawings illustrating, by way of non-limiting embodiments, how the invention can be carried out, and in which.

DETAILED DESCRIPTION

Figure 1:
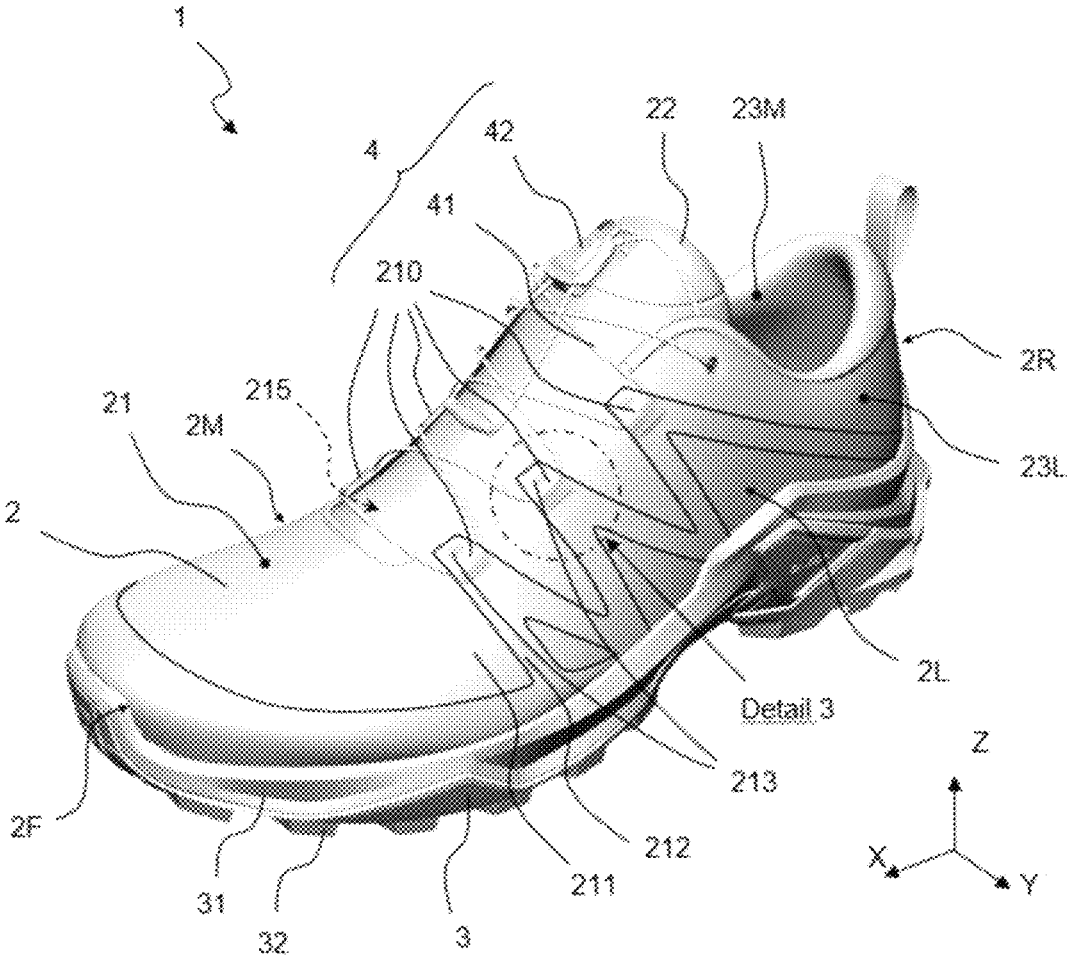
FIG. 1 is a front perspective top view of a shoe for the left foot according to a first embodiment of the invention.
Figure 2:
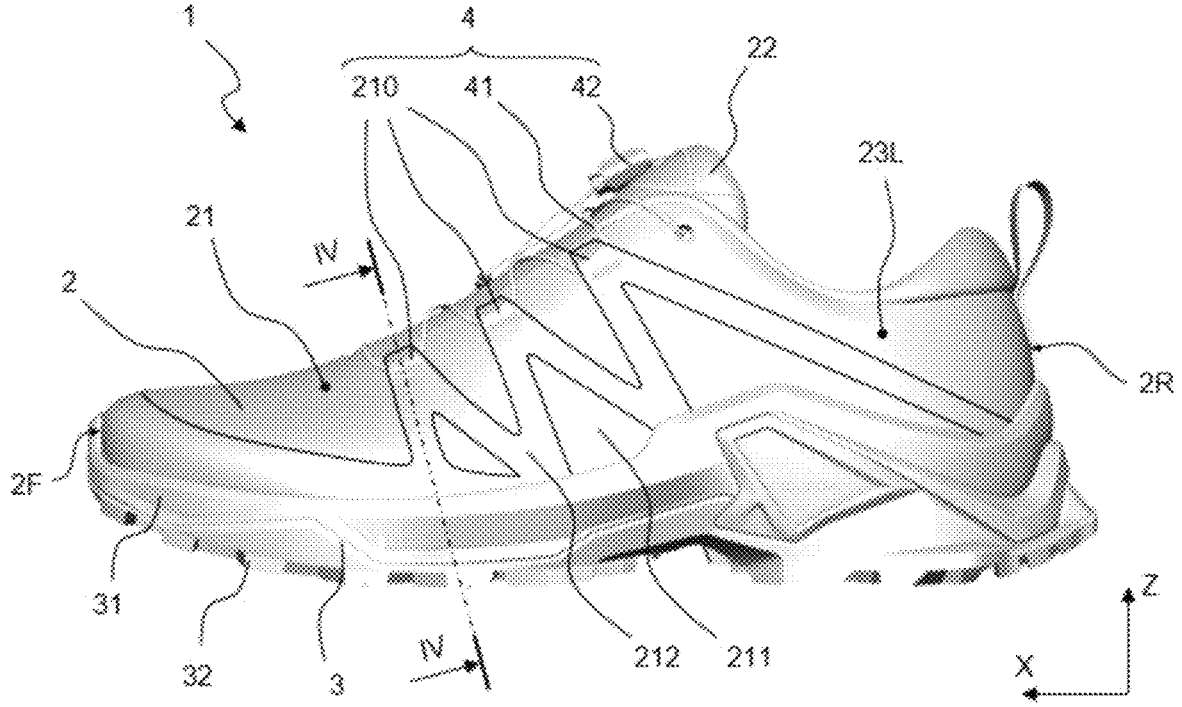
FIG. 2 is a side view of the shoe of FIG. 1.

The following of the description makes use of terms such as "vertical", "upper", "lower", "top", "bottom", "transverse", "lateral", "medial", "right", "left", "horizontal", "anterior", "posterior", "front", "behind", "rear". These terms should be considered as relative terms in relation to the position occupied by the shoe on the foot of a user in normal posture, and the normal direction of forward displacement of a user. A normal posture will be considered to be a configuration for which the sole is laid flat on a horizontal ground.

The terms "lateral" and "medial" are conventionally understood to mean facing outward and inward, respectively. Thus, the medial side of a foot or a shoe is turned towards the medial side of the other foot or other shoe of the user.

The term "longitudinal" refers to a heel-to-toe direction corresponding to the X axis, while the term "transverse" refers to a medial-to-lateral direction (for a left foot) corresponding to the Y axis and, therefore, substantially perpendicular to the longitudinal direction. The vertical or bottom-to-top direction corresponds to the Z axis. A sagittal plane Ps is a plane perpendicular to a Y axis.

The terms "interior" and "inner" designate the elements directed towards the interior of the shoe, oriented towards the foot of the user when inserted in the shoe. Conversely, the terms "exterior" and "outer" designate the elements oriented towards the exterior of the shoe and exposed to the external environment.

In the description, a "shoe" is defined by a "sole assembly" and an "upper". The "sole assembly" is the lower portion of the shoe between the loot and the ground. This is the bottom of the shoe. The sole assembly is positioned opposite the sole of the foot. The "upper" is the upper portion of the shoe enveloping the foot and possibly a portion of the ankle, except for the bottom of the foot. This is the top of the shoe. The upper is affixed to the peripheral edge of the sole assembly. Notable is the fact that certain elements of the shoe can form both a portion of the sole assembly and a portion of the upper.

FIGS. 1 to 5 illustrate the construction of an article of footwear according to a first embodiment of the invention in a sports shoe 1. The sports shoe 1 for the left foot shown is a running shoe but could be a completely different type of sports shoe. The shoe 1 is shown in a perspective, top view in FIG. 1. It comprises an upper 2 overlaying a sole assembly 3. The sole assembly 3 generally comprises a damping layer 31 and a wear layer 32 covering the lower surface of the damping layer 31 and intended to come into contact with the ground. Optionally, an insole 5 can be inserted within the upper 2. This optional layer is intended to be positioned directly under the foot.

The upper 2 comprises a plurality of components.

Figure 8:
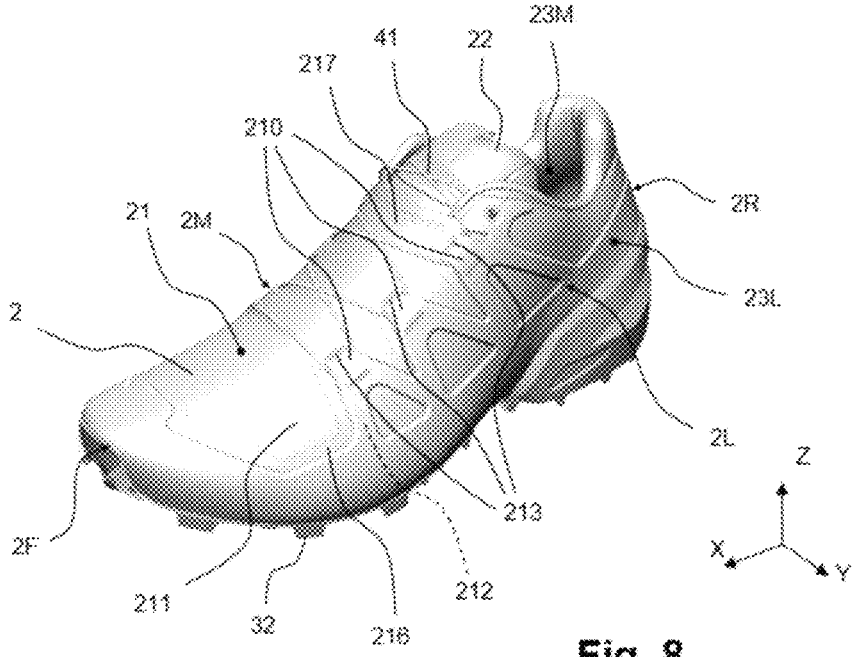
FIG. 8 is a front perspective top view of a shoe for the left foot according to a third embodiment of the invention.
Figure 9:
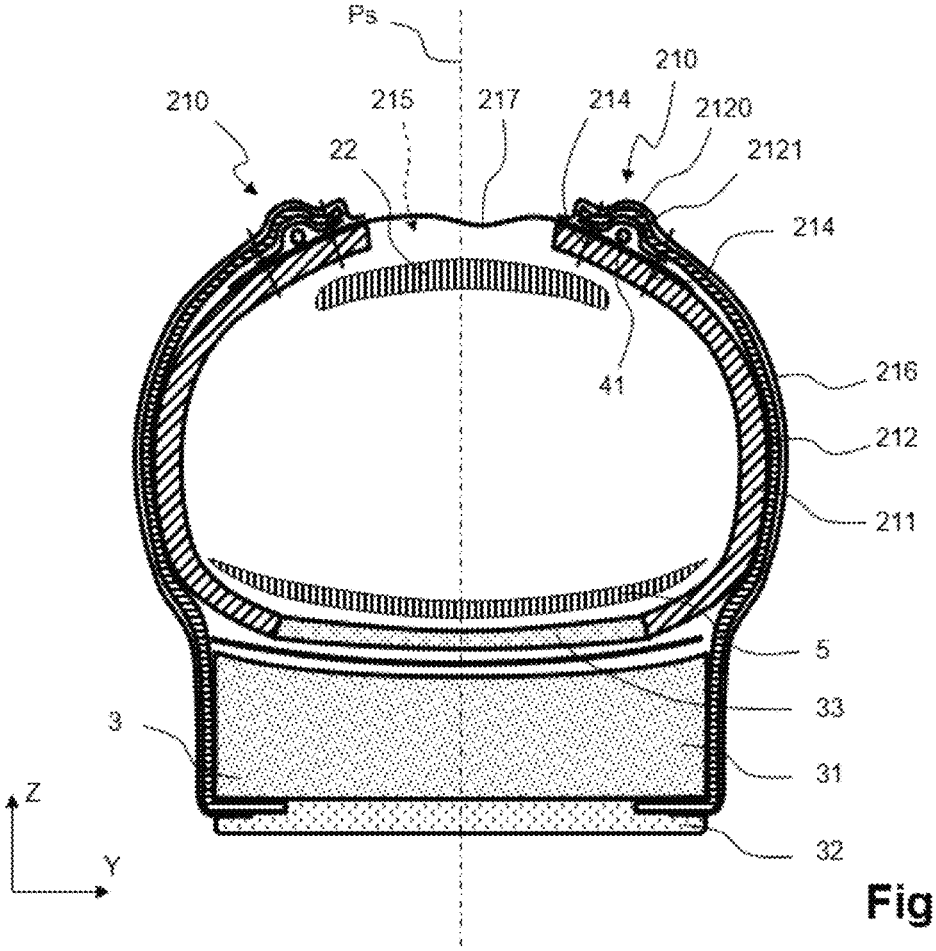
FIG. 9 is a schematic "frontal" cross-section of FIG. 8.
Figure 10:
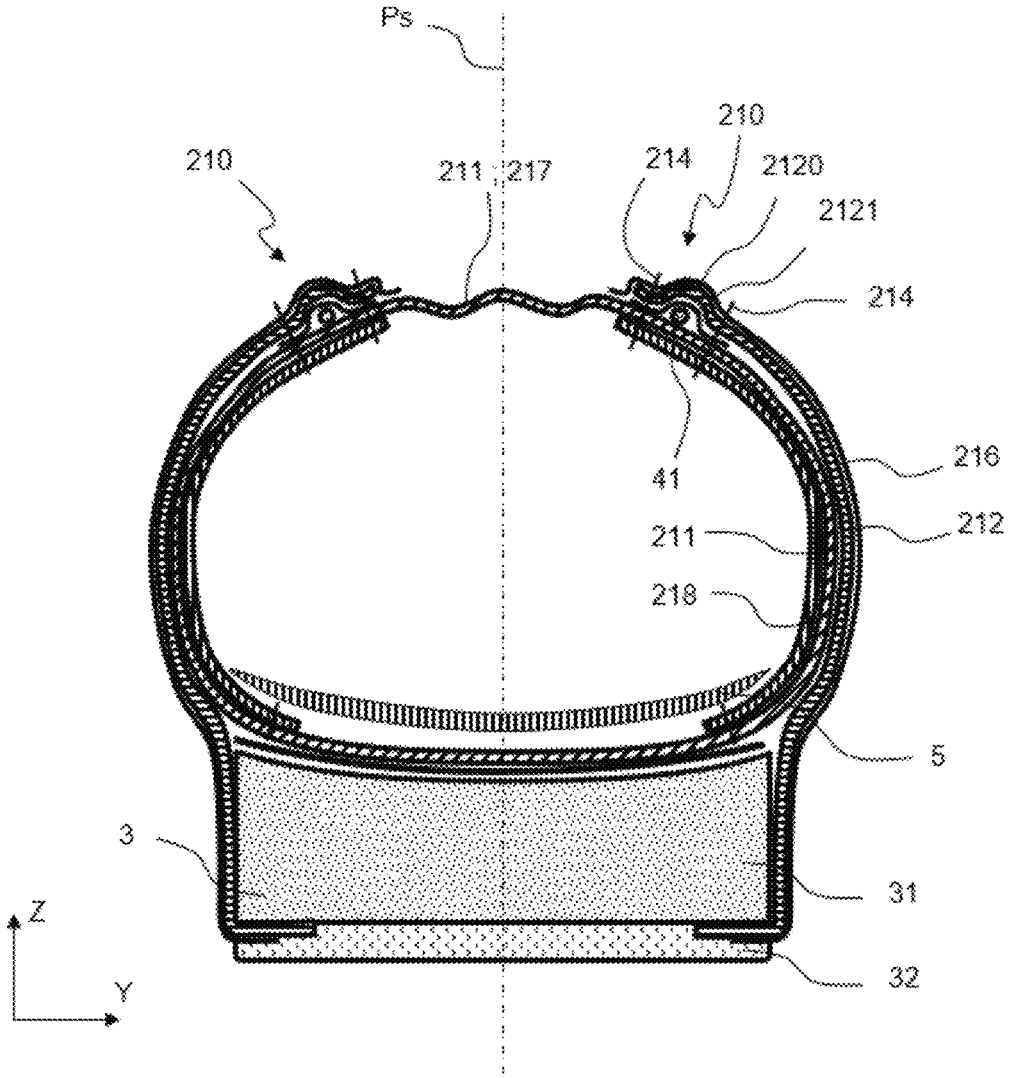
FIG. 10 is a schematic "frontal" cross-section of a fourth embodiment of the invention.

The vamp 21 constitutes a first component. It covers the upper, frontal, lateral and medial portions of the forefoot. In this example, the vamp 21 comprises an upper opening 215, in the area of the instep, closed off by a tongue 22. Alternatively, as illustrated in FIGS. 8 to 10, the vamp does not comprise an upper opening in the area of the instep. The vamp is then continuous between its medial side and its lateral side, in the area of the instep. In this case, the vamp generally comprises at least one flexible and, preferably extensible portion in the zone of the instep.

The optional tongue 22 constitutes a second component of the upper. It is affixed to the vamp 21. The tongue is positioned so as to cover the instep of the user's foot when it is inserted into the shoe.

Lateral 23L and medial 23M quarters constitute third and fourth components of the upper. They form the heel seat and cover the rear, lateral, and medial portions of the hindfoot. The quarters 23L, 23M extend the vamp 21 at the rear thereof in order to form a continuous envelope covering the top and all the sides of the foot. The upper edges of the quarters 23L, 23M and of the tongue 22 or the vamp 21 demarcate an opening for inserting the foot into the shoe.

The upper 2 can be reinforced locally to ensure support of the upper and/or to protect the foot. For example, a "toe cap" may cover the front end of the upper. Similarly, a "counter" can reinforce the portion of the upper 2 surrounding the heel.

The components of the upper 2 can be separate parts. Alternatively, some or all of the components form a unitary part by being, for example, produced via the same process (knitting, weaving, etc.). Certain components may also comprise a plurality of portions assembled to one another in any conventionally known fashion, for example stitching, gluing, or welding. According to certain embodiments, certain components of the upper 2 can extend under the foot to form a portion of the sole assembly 3 or, conversely, certain components of the sole assembly 3 can extend upwards, from the periphery of the sole assembly, to form a portion of the upper 2.

The upper 2 extends lengthwise from a rear end 2R to a front end 2E, and widthwise between a lateral side 2L and a medial side 2M.

Figure 4:
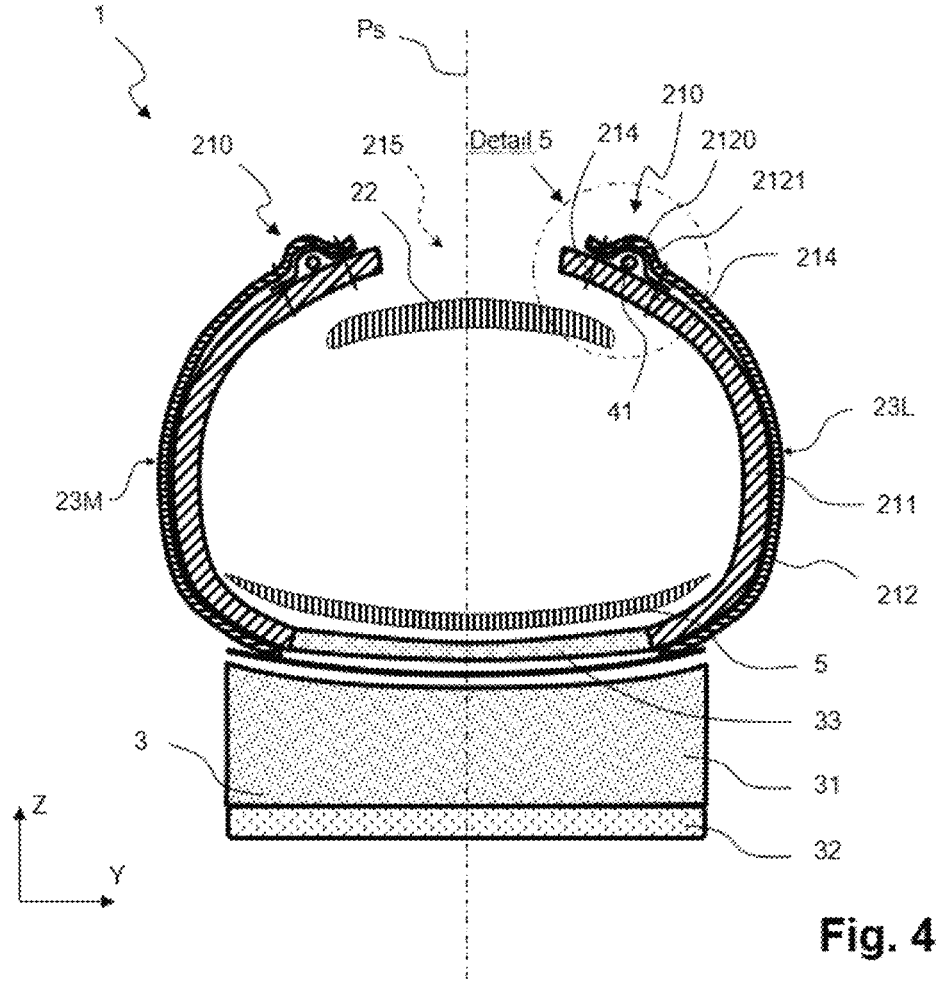
FIG. 4 is a schematic "frontal" cross-section along the line IV-IV of FIG. 2.
Figure 7:
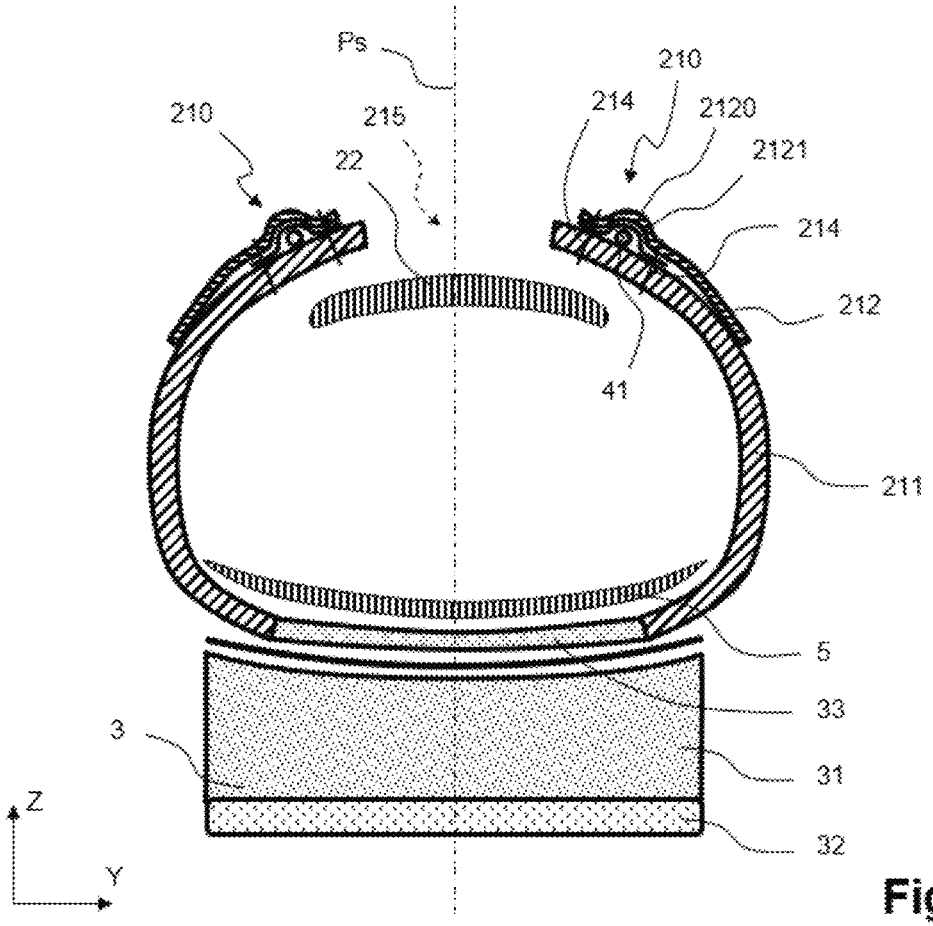
FIG. 7 is a schematic "frontal" cross-section of FIG. 6.

The vamp 21 comprises a first wall 211 connected to the sole assembly 3. The first wall 211 is conventionally fixed to a lasting board 33, for example by stitching. The sub-assembly comprised of the first wall 211 and the lasting hoard 33 is then assembled to the upper surface of the damping layer 31 of the sole assembly. This assembly can be glued. FIGS. 4, 7, and 9 illustrate an assembly of this type.

The first wall 211 can be made with one of the following materials: Polyester (PES, PET), Polyamide (PA), Polyurethane (PU), Polyvinyl Chloride (PVC), or a natural material. One of the natural materials used can be leather, linen, hemp, or wool. So-called "bio-fabricated" materials, a material made from biological organisms (mycelium, bacteria, etc.) may also be used. This material can also incorporate a proportion of recycled material.

The first wall 211 can be a woven, non-woven or knitted textile, a film, or embroidered threads.

In this example, the first wall 211 demarcates the upper opening 215. The lateral and medial sides of the upper opening carry keepers 210 intended to receive a portion of a lace 41. Within the meaning of the invention, a lace 41 can be a cord, wire, or cable. The lace 41 is preferably made of plastic material. For example, the lace is comprised of an outer sheath made of Polyester (PES), Polyamide (PA), or Polytetrafluoroethylene (PTFE). Advantageously, the cross-section of the lace 41 is substantially circular.

To ensure tightening of the instep by the vamp 21, the shoe 1 comprises a tightening system 4 comprised of the lace 41, keepers 210 and, possibly, a blocker 42 allowing adjustment of the lacing length. This tightening system greatly contributes to providing good support of the foot.

The invention relates more specifically to the construction of the keepers 210 of this tightening system.

According to the invention, at least two keepers 210, or even all of the main keepers, are designed as follows. The at least two keepers are intended to receive a lace portion 41, these at least two keepers being arranged on either respective side of a sagittal plane Ps of the article of footwear. The at least two keepers can be arranged symmetrically with respect to the sagittal plane Ps or, alternatively, can be arranged staggered. The sagittal plane Ps can be median or laterally offset. In the latter case, the tightening system is then off-centered with respect to the median sagittal plane of the shoe. In the embodiment of FIGS. 1 to 5, the sagittal plane Ps is located between the edges of the upper opening 215.

The vamp 21 comprises a yoke 212 locally covering an outer surface 211*e* of the first wall 211.

The yoke 212 can be made with one of the following materials: Polyester (PES, PET), Polyamide (PA), Polyurethane (PU), Polyvinyl Chloride (PVC), or a natural material. One of the natural materials used can be leather, linen, hemp, or wool. So-called "bio-fabricated" materials, a material made from biological organisms mycelium, bacteria, etc.) can also be used. This material can also incorporate a proportion of recycled material.

The yoke be a woven, non-woven or knitted textile, a film, embroidered threads.

The yoke 212 is fixed to the first wall 211 due to a first affixing means 213, or first affixer, located in a first connection zone 213Z close to a sagittal plane Ps, and therefore, in this example, in the vicinity of an edge of the upper opening 215. Within the meaning of the invention, the term "close to" means that the first connection zone 213Z is located closer to the sagittal plane, in the upper portion of the first wall, than to the lower portion of the first wall, the portion connected to the sole assembly. In the case in which the upper comprises an upper opening 215, the first connection zone 213Z is located in the vicinity of the edges of the opening. It may be a zone extending from the edge of the opening by up to fifteen millimeters away from the edge. In the case in which the upper does not include an upper opening 215, the upper limit of the first connection zone 213Z is advantageously distant from the sagittal plane by at least one centimeter and, advantageously, by less than three centimeters. This first connection zone can extend up to a lower limit that is fifteen millimeters away from the upper limit. Thus, the first affixing means 213 creates an upper linkage between the first wall 211 and the yoke 212. In this example, the yoke 212 is also fixed to the first wall 211 due to a second affixing means 214, or second affixer, located in a second connection zone 214Z distant from the first connection zone 213Z, moving away from the sagittal plane Ps and, therefore, from the upper opening 215 in this example. The two affixing means, or affixers, are spaced apart by a distance d, measured between the adjacent edges of these two affixing means. Between the two connection zones 213Z, 214Z, the yoke 212 is not fixed to the first wall 211. In other words, the yoke 212 forms a bridge between the two connection zones 213Z, 214Z. Thus, this construction makes it possible to define an interstitial space 2101 demarcated by a portion of the outer surface 211*e* of the first wall 211, a portion of an inner surface 212*i* of the yoke 212 and the first and second affixing means 213, 214. This interstitial space 2101 leads to a front opening 2102*f*, on side of the front of the foot, and to a rear opening 2102*r*, on the side of the heel. This interstitial space 2101 defines a keeper 210 within the meaning of the invention. A portion of the lace 41 is intended to be housed in this interstitial space 2101 upon passing through the two openings 2102*f*, 2102*r* defining the inlet and outlet of the interstitial space 2101.

Generally, the keepers of the prior art are made by straps folded over themselves so as to form a loop for passage of a portion of the lace. The construction according to the invention is specific in that the yoke 212 is assembled to the first wall 211 so as to be superimposed directly on the first wall 211, without folding or turning over a portion of the yoke 211. Thus, between the two connection zones 213Z, 214Z, the outer surface 211*e* of the first wall 211 is very close to the inner surface 212*i* of the yoke 212, or even almost in contact, surface against surface. Here, the first wall is thus covered by layer having only the thickness of the yoke 212. This design makes it possible to obtain a keeper 210 that is particularly flat and compact, tight, aesthetic, comfortable, simple and inexpensive to produce. In addition, because the bridge formed by a portion of the yoke is fixed only to the outer surface of the first wall, the insulation of the shoe is improved by reducing the thermal bridge in the area of the keeper and water infiltration.

To qualify the strength of the keepers, the manufacturers will carry out a plurality of tests to ensure that the tightening system does not deteriorate in use. For example, the applicant will conduct at least the following tests.

A tensile test involves inserting a lace or cable in the keeper. Then, a tensile force is exerted in the area of the free ends of the lace, along a direction corresponding to the normal traction of the lacing. The threshold force necessary to cause the deterioration of the loop is then measured. This threshold force must be greater than a targeted reference value.

An abrasion test involves inserting a lace or cable in the keeper. Then, a reference mass is hung at one end while orienting the lace so that the tension is oriented along a direction corresponding to the normal traction of the lacing. Finally, an alternating traction is exerted at the other end so as to cause a to-and-fro movement of the lace in the area of the keeper, along to a predetermined course. The wear of the lace and of the keeper is then analyzed after a targeted number of reference cycles, a cycle being a round trip or back-and-forth movement along the predetermined course. The keeper and the lace must have an acceptable normal wear and tear, as the tightening system must remain functional.

For these two tests, only a cut portion of the upper close to the keeper will be used.

The claimed construction is designed to comply with these tests.

According to one embodiment, the yoke 212 comprises at least two layers, including an outer layer 2120 and an inner layer 2121. The outer layer 2120 can be made using one of the previously described materials as the constituent material of the yoke. The inner layer 2121 is made with a low-abrasive material. Such a low-abrasive material can be Polyester (PES), Polyamide (PA), Polyethylene (FE). The inner layer 2121 covers at least the zone located between the two connection zones 213Z, 214Z. The inner surface of the inner layer 2121 is considered here as constituting the inner surface 212*i* of the yoke 212, The inner layer 2121 can be a coating affixed to the inner surface of the outer layer 2120, locally or entirely, for example by projection, impregnation, or any other equivalent means. Alternatively, the inner layer 2121 can be a separate component, attached and fixed to the inner surface of the outer layer 2120. For example, the attached component can be a canvas, a textile, a plate, etc. Furthermore, this attached component can be fixed to the yoke 212 by any suitable means. It can be gluing, stitching or else. According to a non-limiting example, the inner layer 2121 is produced by a Polyester fabric glued and sewn locally on the inner surface of the yoke. This inner layer 2121 of low-abrasive material contributes to facilitating compliance of the keeper with the abrasion test as defined previously, by protecting the outer layer 2120 from wear by friction generated by the sliding of the lace within the keeper. This construction involving having an attached component makes it possible to limit, to a functional zone, the use of low-abrasive material which can prove to be costly. A more cost-effective material can then be used for the outer layer.

According to one embodiment, the yoke 212 is monolayer. In this case, this single layer can advantageously be made with a low-abrasive material.

Advantageously, the thickness of the yoke, whether multilayer or monolayer, is less than 1.5 millimeters. This enables the keeper to be particularly flat.

According to one embodiment, the distance d between the two affixing means 213, 214 is between five and ten millimeters. This makes it easy to pass the lace through the loop while properly retaining the yoke and keeping the lace in the keepers, by preventing the lace from being loose in these keepers.

The first and second affixing means 213, 214 can be any appropriate means to ensure the strength of the keepers 210, particularly to comply with the tests defined above. These affixing means 213, 214 can be a stitch, an adhesive or glue, a weld, a rivet, etc. The second affixing means 214 can be different from the first affixing means 213. Indeed, the tensile strength and resistance to abrasion mainly involve the first affixing means 213. The second affixing means requires less strength. For example, the first affixing means 213 can be a stitch, and the second affixing means 214 an adhesive. The yoke 212 can include a third affixing means. For example, the yoke 212 can be glued to the first wall in the lower portion of the vamp 21, from the sole assembly up to and including the second connection zone 214Z.

The first affixing means 213 is designed and dimensioned so that the keeper remains functional after a tensile test as defined previously, with a targeted reference value of 150 Newton.

The first affixing means 213 is designed and dimensioned so that the keeper remains functional after an abrasion test as defined previously, with a reference mass of 1 kg and a targeted number of reference cycles of at least 2,000 cycles.

According to one embodiment, the first affixing means 213 is a zigzag stitch. It can also be a tight zigzag "bartack" stitch. These stitches include bar tacks to prevent the stitch from coming undone. Conventionally, these stitches are made with Polyamide (PA) or Polyester (PES) yarns. This type of stitching is dimensioned so that the stitch is strong enough for the keeper to be compliant with the desired requirements of the tensile and abrasion tests as previously described.

Figure 3:
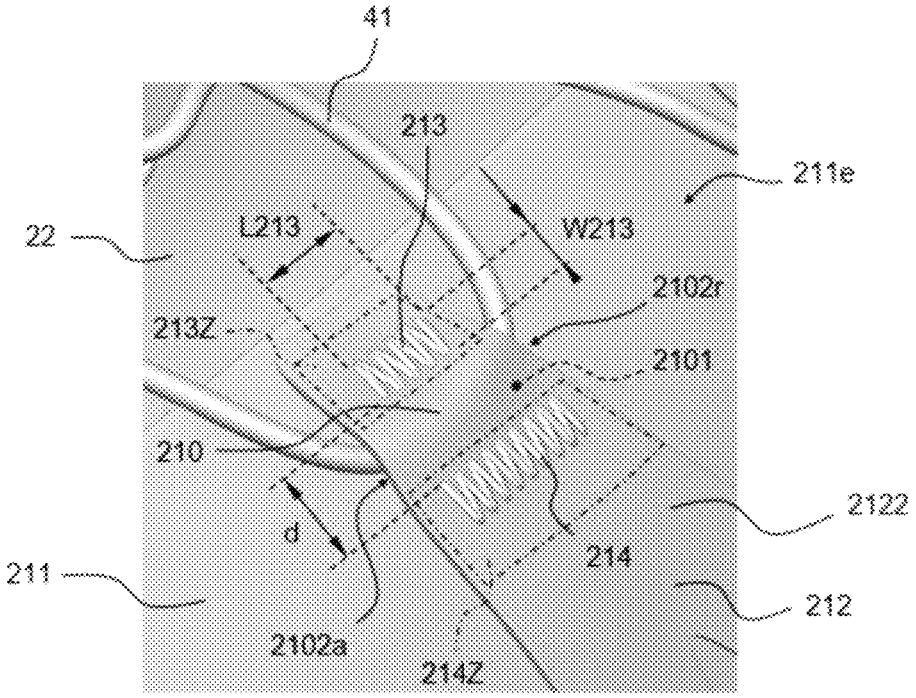
FIG. 3 is a detail view 3 of a keeper of the shoe of FIG. 1.

According to an embodiment illustrated in FIG. 3, the stitching is linear, which makes it simple and easy to make, particularly with an automated process. The length L213 of the stitching constituting the first affixing means 213 is greater than five millimeters. This ensures strength and retention of the structure of the tightening system 4. The keeper 210 retains good strength in use. This dimensioning allows compliance of the keeper with the tensile and abrasion tests according to the criteria defined above. Advantageously, the length L213 of the stitch 213 is less than ten millimeters. Furthermore, the width of the yoke in the area of the first affixing means is advantageously less than fifteen millimeters. This dimension makes it possible to have a lacing path adapted for comfortable tightening, which adjusts more closely to the morphology of the instep. To provide the stitch 213 with good strength, the width W213 of the stitch 213 is advantageously greater than two millimeters, and preferably less than five millimeters.

According to another embodiment, the stitching may not be linear in order to improve the strength and retention of the keeper. It may be a curved or V-shaped stitch.

Figure 5:
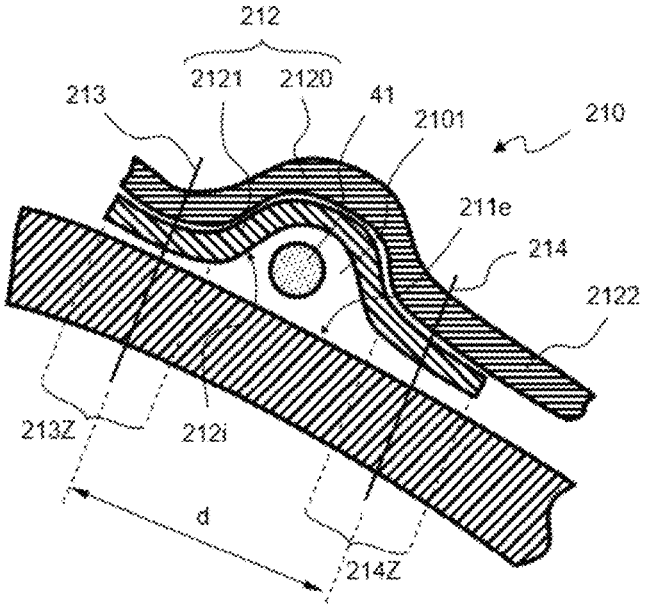
FIG. 5 is a detail view 5 of a keeper of the shoe of FIG. 4.

FIGS. 3 and 5 are detail views of the construction of keepers according to an embodiment in which the affixing means 213, 214 are stitches. In FIG. 5, the stiches are represented by lines. The distance d between the stitches corresponds to the space between the edges of the opposite stitches. This construction of the keepers transposes directly to the construction of the keepers of the embodiments described in FIGS. 6-7, 8-9 and 10.

According to one embodiment, as shown in FIGS. 1-2, 6, and 8, the same yoke 217 is used and dimensioned to make a plurality of adjacent keepers 210. For example, the yoke 212 forms a unitary assembly comprising a plurality of upper extensions 2122 connected to one another in the lower portion of the yoke. Each upper extension 2122 is designed to form a keeper 210, thus covering the two connection zones 213Z, 214Z associated with the corresponding keeper 210.

According to one embodiment, as shown in FIGS. 1 and 8, the yoke 212 can extend in the lower portion of the vamp 21 until connecting, for example, to a sole assembly 3 of the article of footwear 1. Thus, the yoke 212 contributes to a better tightening of the foot, the take-up of force being transmitted more directly to the sole assembly. This construction contributes to improving the comfort of foot support.

The yoke 212 can be connected in the area of a peripheral zone of the upper surface of the damping layer 31, as illustrated in FIGS. 1 to 7. Alternatively, the yoke 212 can partially or completely cover the sides of the damping layer 31 and can be inserted locally between the damping layer 31 and the wear layer 32, as illustrated in FIGS. 8 to 10.

According to one embodiment, the yoke 212 comprises a first affixing means 213, in the vicinity of a sagittal plane Ps, and is affixed to the sole assembly in the area of the junction between the upper and the sole assembly 3. Apart from these two fastening zones, the yoke 212 is not fixed to the first wall 211.

Figure 6:
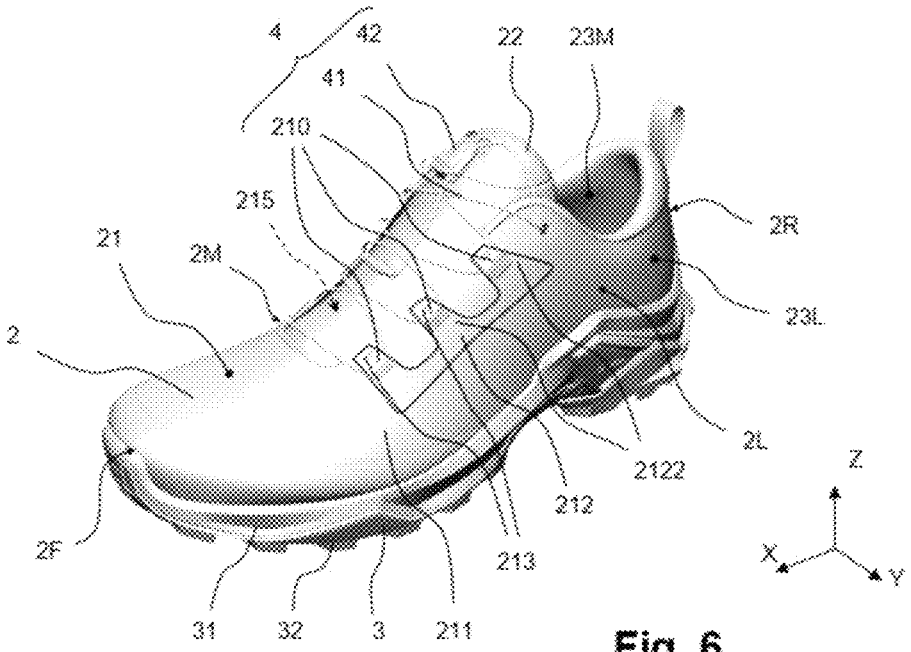
FIG. 6 is a front perspective top view of a shoe for the left foot according to a second embodiment of the invention.

Alternatively, the yoke 212 is fixed to the first wall. 211 only in the vicinity, of the keepers 210, without extending to the sole assembly 3. FIGS. 6 and 7 illustrate an alternative embodiment.

The yoke 212 can also form all the keepers 210 of the shoe 1. In this case, the medial and lateral portions carrying the upper lateral and medial extensions intended to form the keepers 210 can be connected to one another in the area of the front of the vamp 21.

According to one example, as shown in FIGS. 8 to 10, the yoke and/or a portion of the first wall is covered by a protective film 216 made of Thermoplastic Polyurethane (TPU) or equivalent. This protects the yoke from the weather, improves waterproofing and improves the aesthetics of the vamp. Thus, in these drawing figures, the yoke 212 is not visible, but is hidden by the protective film 216.

According to another embodiment, the vamp does not include an upper opening. The vamp is then continuous between its medial side and its lateral side, in the area of the instep. In this example, the vamp comprises at least one flexible, and preferably extensible portion 217 in the instep zone, and more particularly between the keepers 210. The construction is similar to the embodiments described previously with the difference that the upper opening 215 is closed off by the flexible portion 217. The flexible portion 217 can be an attached component fixed to the first wall, as illustrated in FIG. 9. Alternatively, the flexible portion 217 can be a portion of the first wall of the vamp, as illustrated in FIG. 10. In this latter example, the first wall forms a flexible textile envelope 211. Here, the vamp 21 is reinforced locally by reinforcing strips 218 extending within the envelope, from the sole assembly 3 to an upper end corresponding to the first connection zone 213Z. On one side, the reinforcing strip 218 is fixed to the sole assembly and, at the other end, in the area of the first connection wine 213Z, the reinforcing strip 218 is fixed to the yoke 212, as well as to the envelope forming the first wall, due to the first affixing means 213. Alternatively, this latter construction may not have reinforcing strips 218.

The invention is not limited to the embodiments previously described. It is also possible to combine these embodiments. The invention extends to all of the embodiments covered by the appended claims.

Further, at least because the invention is disclosed herein in a manner that enables one to make and use it, by virtue of the disclosure of particular exemplary embodiments of the in ration, the invention can be practiced in the absence of any additional element or additional structure that is not specifically disclosed herein.

REFERENCES

1. Shoe
2. Upper
21. Vamp
210. Keeper
2101. Interstitial space
2102*a*. Anterior opening
2102*r*. Posterior opening
211. First wall
211*e*. Outer surface
212. Yoke
212*i*. Inner surface
2120. Outer layer
2121. Inner layer
2122. Upper Extension
213. First affixing means (or affixer)
213Z. First connection zone
214. Second affixing means (or affixer)
214Z. Second connection zone
215. Upper opening
216. Protective film
217. Flexible Portion
218. Reinforcing strip
22. Tongue
23L. Lateral quarter
23M. Medial quarter
3. Sole assembly
31. Damping layer
32. Wear layer
33. Lasting board
4. Lacing system
41. Lace
42. Blocker
5. Insole

The invention claimed is:

1. Article of footwear comprising:
an upper comprising a vamp, the vamp including:
a first wall;
at least two keepers configured to receive a portion of a lace, each keeper being arranged on either side of a sagittal plane of the article of footwear,
each of the two keepers being defined by:
an interstitial space between the first wall and a yoke locally covering an outer surface of the first wall;
the interstitial space having an anterior opening and a posterior opening through which a portion of the lace can extend; and
an upper linkage between the first wall and the yoke, the upper linkage being achieved by a first affixer located in a first connection zone proximate the sagittal plane;
the yoke being superimposed on the first wall without folding.

2. Article of footwear according to claim 1, wherein:
the yoke comprises an inner layer made with a low-abrasive material.

3. Article of footwear according to claim 2, wherein:
the yoke comprises at least two layers, including an outer layer and an inner layer, the inner layer being an attached component fixed to the inner surface of the outer layer.

4. Article of footwear according to claim 1, wherein:
the first affixer comprises a zigzag stitch.

5. Article of footwear according to claim 4, wherein:
the stitch, constituting the first affixer, has a length greater than five millimeters and a width greater than two millimeters.

6. Article of footwear according to claim 1, wherein:
the yoke is fixed to the first wall by a second affixer located in a second connection zone distant from the first affixer, extending away from the sagittal plane so that a distance between the first affixer and the second affixer is between five and ten millimeters.

7. Article of footwear according to claim 1, wherein:
the yoke is connected to a sole assembly of the article of footwear.

8. Article of footwear according to claim 1, wherein:
a same yoke is used and dimensioned to make a plurality of keepers.

9. Article of footwear according to claim 8, wherein:
the same yoke makes possible keepers on either side of the sagittal plane.

10. Article of footwear according to claim 1, wherein:
the yoke and/or a portion of the first wall is covered by a protective film.

* * * * *